US007122971B2

(12) United States Patent
Yeh et al.

(10) Patent No.: US 7,122,971 B2
(45) Date of Patent: Oct. 17, 2006

(54) DRIVER CIRCUIT FOR DRIVING A PLURALITY OF DC LAMP STRINGS

(75) Inventors: Ching-Chiang Yeh, Gangshan Township, Kaohsiung County (TW); Chung-Lung Pai, Taipei (TW); Wei-Hsin Wei, Wufong Township, Taichung County (TW)

(73) Assignee: Richtek Technology Corp., Hsinchu (TW)

( * ) Notice: Subject to any disclaimer, the term of this patent is extended or adjusted under 35 U.S.C. 154(b) by 0 days.

(21) Appl. No.: 10/976,809

(22) Filed: Nov. 1, 2004

(65) Prior Publication Data

US 2005/0093473 A1 May 5, 2005

(30) Foreign Application Priority Data

Nov. 5, 2003 (TW) ..... 92131006 A

(51) Int. Cl.
*H05B 37/00* (2006.01)
*H05B 39/00* (2006.01)

(52) U.S. Cl. ..... 315/185 R; 315/216; 315/291; 315/297; 315/194; 315/129; 315/247; 315/300; 315/302

(58) Field of Classification Search ..... 315/291, 315/216, 185 R, 194, 297, 129, 247, 312, 315/315
See application file for complete search history.

(56) References Cited

U.S. PATENT DOCUMENTS 6,864,641 B1 * 3/2005 Dygert ..... 315/216

* cited by examiner

*Primary Examiner*—Tho Phan
*Assistant Examiner*—Chuc Tran
(74) *Attorney, Agent, or Firm*—Rosenberg, Klein & Lee

(57) ABSTRACT

A driver circuit for a DC light source supplies a voltage generated by a DC-to-DC converter for a plurality of lamp strings connected in parallel and a plurality of driving currents generated by a current mirror for the lamp strings, such that the lamp strings may have well controlled or uniform brightness.

7 Claims, 2 Drawing Sheets

DRIVER CIRCUIT FOR DRIVING A PLURALITY OF DC LAMP STRINGS

FIELD OF THE INVENTION

The present invention is related generally to a driver circuit for a DC (direct current) light source and more particularly, to a driver circuit for driving a plurality of DC lamp strings.

BACKGROUND OF THE INVENTION

Cold cathode fluorescent lamps (CCFLs) are used in large-scale display panels for backlight sources thereof. However, it is disadvantageous of using CCFLs in display panels, since a display panel is powered by DC power source while CCFL is driven by AC (alternating current) power. It is thus needed DC-to-AC converter in a display module to convert DC supply voltage to AC voltage for driving the CCFLs thereof, and the cost and volume of the circuit for the display are increased accordingly. Due to driven by DC power, light-emitting diodes (LEDs) attract more and more attentions for light sources of display panels.

FIG. 1 shows a conventional driver circuit 100 for a DC light source utilizing LEDs as the lamp elements thereof, which comprises a boost or buck DC-to-DC converter 102 having an input $V_{IN}$ connected to an input node 104, an input SW connected to a node 106, an input SHON receiving a clock 108, a ground terminal GND connected to ground, and a feedback input FB receiving a feedback current $I_{FB}$, a capacitor C1 connected between the input node 104 and ground, an inductor L1 connected between the nodes 104 and 106, a diode D1 connected between the node 106 and an output node 110, a capacitor C2 connected between the output node 110 and ground, a resistor R1 connected between the feedback input FB and ground, and a string of light-emitting diodes LED1, LED2 and LED3 connected between the output node 110 and feedback input FB. The input voltage $V_{in1}$ connected to the input node 14 is converted by the converter 102 to generate a voltage $V_{in2}$ on the node 106 to supply for the lamps LED1, LED2, and LED3 to light them up.

However, light source composed of LED string is currently applicable to small-scale display panels only, due to the fact that much larger number of LEDs connected in series is required in a large-scale panel for sufficiently illuminating the whole panel. Nevertheless, the more the LEDs are connected in series, the higher the start-up voltage is required. Typically, 3.5 V is increased more for the voltage when one more LED is connected in series. If several LEDs are alternatively connected in parallel to reduce the required start-up voltage, a non-uniform brightness may be presented on the LEDs owing to non-uniform currents flowing through the LEDs. Consequently, LEDs are only used for the backlight sources in small-scale display panels, but not in large-scale display panels.

Therefore, it is desired a driver circuit for driving LEDs, especially for large-scale display panels.

SUMMARY OF THE INVENTION

One object of the present invention is to provide a driver circuit for driving a plurality of DC lamp strings.

Another object of the present invention is to provide a driver circuit for driving LEDs in a large-scale display panel.

A driver circuit for driving a plurality of DC lamp strings, according to the present invention, comprises a DC-to-DC converter to convert a first input voltage to a second input voltage, a plurality of lamp strings connected in parallel and each of them connected to the second voltage, and a current mirror to supply a plurality of driving currents for the lamp strings. Preferably, each of the lamp strings may include one or more LEDs connected in series.

The driving currents supplied for the lamp strings are capable of maintained substantially equal to each other and independent on temperature and environment by regulating the reference current on the reference branch of the current mirror by the DC-to-DC converter based on a feedback signal derived from the reference current. Moreover, the voltage supplied for the lamp strings are capable of maintained invariable, regardless of the number of the lamp strings connected in parallel, and thus the driver circuit is advantageous to and suitable for large-scale display panels. Further, only one driver circuit is required for a large light source, without the need to provide each set of LEDs with one respective driver circuit as the prior art did, whereby the cost and volume of the driver circuit may be also reduced.

BRIEF DESCRIPTION OF DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
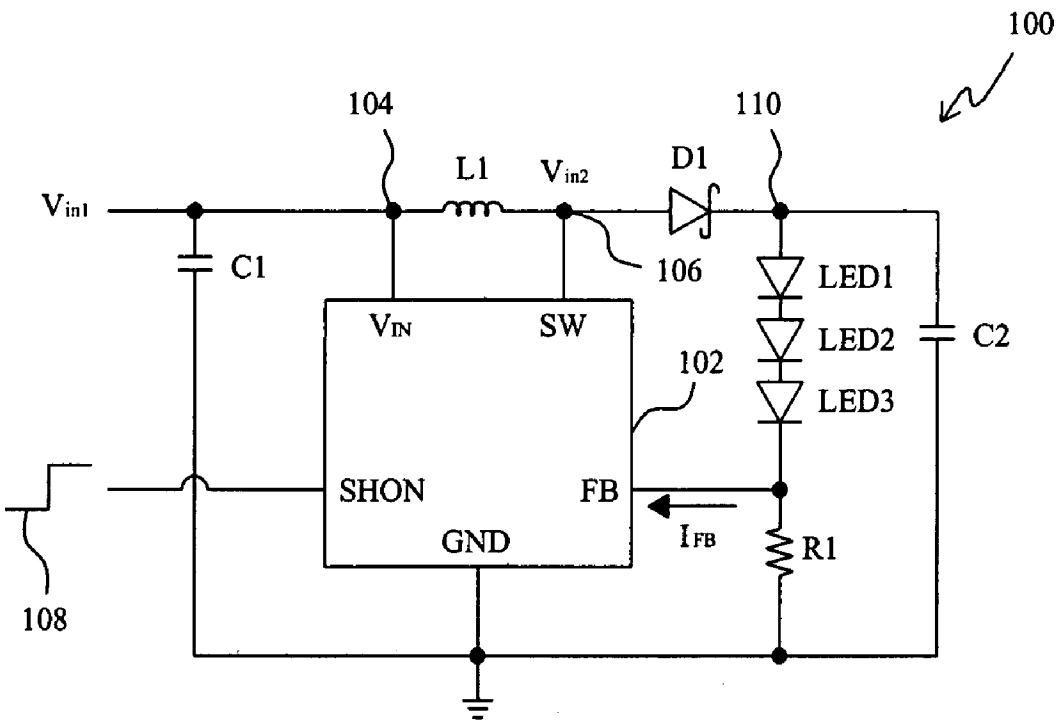
FIG. 1 (PRIOR ART)
FIG. 1 shows a conventional driver circuit to drive a plurality of LEDs connected in series.
Figure 2:
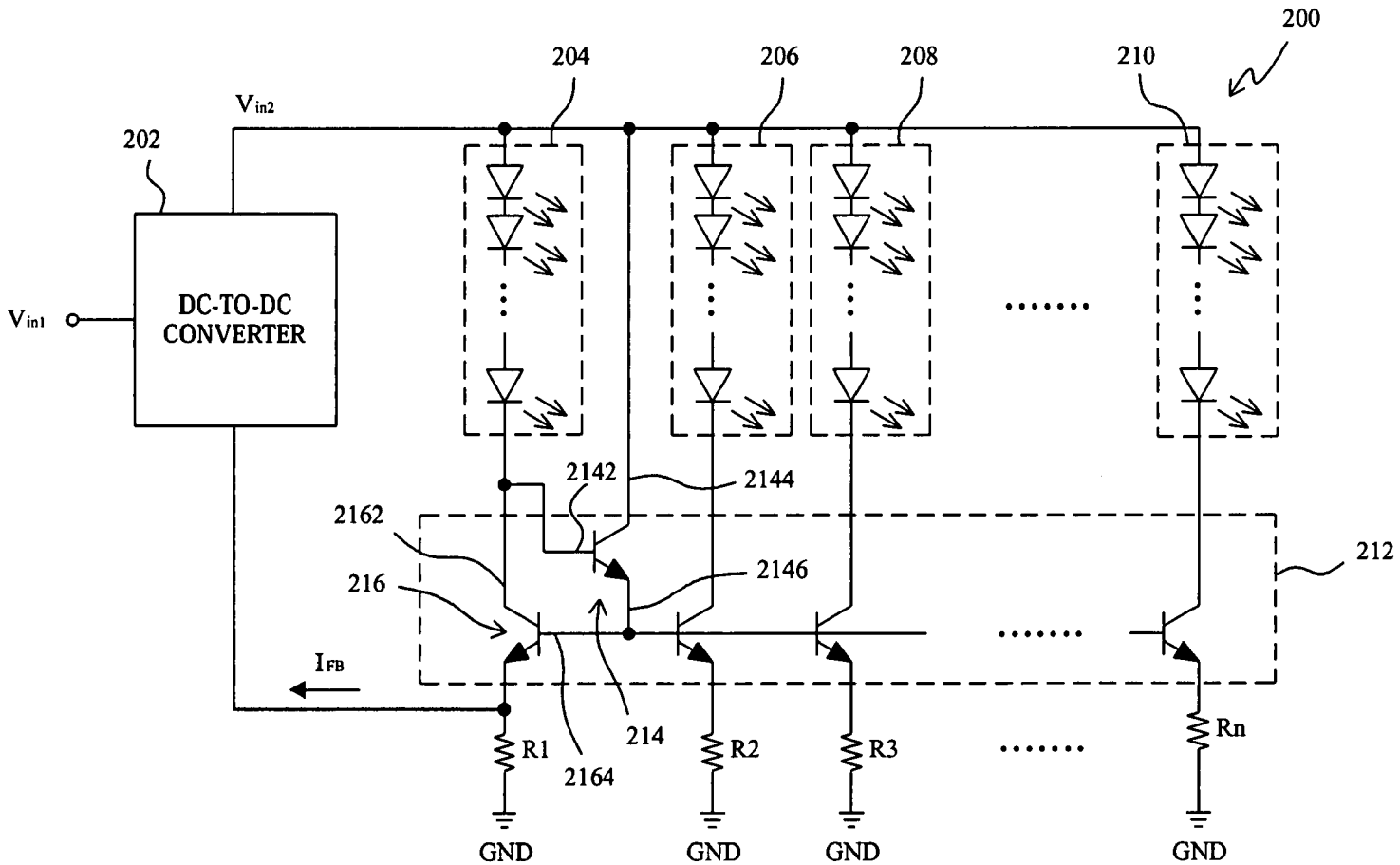
FIG. 2 shows a driver circuit for driving a plurality of DC lamp strings according to the present invention.

FIG. 2 shows a driver circuit 200 for driving a plurality of DC lamp strings according to the present invention, in which a boost or buck DC-to-DC converter 202 converts an input voltage $V_{in1}$ to a voltage $V_{in2}$ to supply for a plurality of lamp strings 204, 206, 208, . . . , 210, and each of the lamp strings includes several LEDs connected in series. To regulate the driving currents supplied for the lamp strings 204–210, a current mirror 212 has its reference branch connected to one of the lamp strings 204–210, for example the lamp string 204, and a plurality of mirror branches connected to the other lamp strings 206-210, respectively, and each of the reference branch and mirror branches is grounded through resistors R1, R2, R3, . . . , Rn, respectively. Since all the driving currents supplied for the lamp strings 204–210 are generated by mirroring the reference current flowing on the reference branch of the current mirror 212, their magnitudes and thus the brightness the LEDs emitted can be well controlled, particularly to be uniform. Moreover, a feedback current $I_{FB}$ is received by the DC-to-DC converter 202 from the reference branch of the current mirror 212 to regulate the reference current. In this embodiment, the current mirror 212 is a proportional type of current mirror, and each mirrored current thereof has a ratio to the reference current determined by the ratio of the transistors of the mirror branch and reference branch. A transistor 214 is further introduced between the collector 2162 and base 2164 of the transistor 216 on the reference branch, so as to obviate the effect of β of the transistor 216. The transistor 214 has its base 2142 connected to the collector 2162 of the transistor 216, its collector 2144 connected with the voltage $V_{in2}$, and its emitter 2146 connected to the base 2164 of the transistor 216.

Referring to FIG. 2, the voltage supplied for each of the lamp strings 204–210 is $V_{in2}$, regardless of the number of the lamp strings used in a light source, because all the lamp strings are connected in parallel. The lamp strings 204–210 will have uniform brightness owing to substantially equal currents supplied by the current mirror 212 for each of them. Moreover, the effect of β of the transistor 216 on the branch of the current mirror 212 is obviated by the transistor 214. The reference current on the reference branch of the current mirror 212 is stabilized, independent on temperature and environment, by the DC-to-DC converter 202 based on the feedback current $I_{FB}$. The resistor R1 may be a variable resistor, whereby the reference current on the reference branch of the current mirror 212 is adjusted by the resistance of the resistor R1.

The voltage $V_{in2}$ can be maintained at a lower level no matter how many LEDs are used in a light source, since they may be diverged in several lamp strings connected in parallel, and the minimum of the voltage $V_{in2}$ is determined by the number of the LEDs included in a lamp string and the start-up voltage of one LED thereof. By mirroring the reference current of the current mirror to generate the driving currents for the lamp strings, each LED of the light source can be unified to a brightness due to the substantially equal driving currents.

According to the principles of the present invention and illustrated by the above embodiments, any other lamps driven by DC power can have well controlled brightness by the proposed driver circuit.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as string forth in the appended claims.

What is claimed is:

1. A driver circuit for a DC light source, comprising:

a DC-to-DC converter for converting a first input voltage to a second input voltage;

a plurality of lamp strings connected in parallel, each of the lamp strings connected with the second voltage; and a current minor having a reference branch establishing a reference current therein and connected to one of the lamp strings for supplying the reference current therein, and a plurality of minor branches for mirroring the reference current to generate a plurality of mirrored currents each for supplying a respective one of the other lamp strings, wherein the DC to DC converter includes a feedback input connected with a feedback signal proportional to the reference current for regulating the reference current.

2. The driver circuit of claim 1, wherein each of the lamp strings includes a plurality of light-emitting diodes connected in series.

3. The driver circuit of claim 1, wherein the DC-to-DC converter includes a boost DC-to-DC converter.

4. The driver circuit of claim 1, wherein the DC-to-DC converter includes a buck DC-to-DC converter.

5. The driver circuit of claim 1, wherein the current mirror includes a proportional type of current mirror.

6. The driver circuit of claim 1, further comprising a variable resistor connected with the reference branch for adjusting the reference current.

7. A driver circuit for a DC light source, comprising:

a DC-to-DC converter for converting a first input voltage to a second input voltage;

a plurality of lamp strings connected in parallel, each of the lamp strings connected with the second voltage; and a current mirror having a reference branch establishing a reference current therein and connected to one of the lamp strings for supplying the reference current therein, and a plurality of mirror branches for mirroring the reference current to generate a plurality of mirrored currents each for supplying a respective one of the other lamp strings, the reference branch including a first transistor for generating the reference current and a second transistor connected to the first transistor for obviating an effect of β of the first transistor, wherein the first transistor operates as a forward biased diode.

* * * * *